United States Patent [19]

Bynam

[11] 4,108,442

[45] Aug. 22, 1978

[54] GOLF BOARD GAME APPARATUS

[76] Inventor: Holland Eldridge Bynam, Hq. 2-36 Infantry, APO New York, N.Y. 09045

[21] Appl. No.: 672,234

[22] Filed: Mar. 31, 1976

[51] Int. Cl.[2] ..... A63F 3/00

[52] U.S. Cl. .....273/237; 273/245

[58] Field of Search ..... 273/134, 134 CG, 134 A, 273/136 A, 130 AB, 131 A, 135 A, 1 E, 245, 237

[56] References Cited

U.S. PATENT DOCUMENTS

| | | | |
|---|---|---|---|
| 1,316,048 | 9/1919 | Le Massena | 273/134 CG |
| 1,513,941 | 11/1924 | Smith | 273/134 DB |
| 2,157,172 | 5/1939 | Hays | 273/134 CB |
| 3,260,526 | 7/1966 | Seitz | 273/134 CG |

FOREIGN PATENT DOCUMENTS

| | | | |
|---|---|---|---|
| 1,182,596 | 2/1970 | United Kingdom | 273/134 CG |

OTHER PUBLICATIONS

"Chess Mate;" Electronics; p. 44; Mar. 4, 1976.

*Primary Examiner*—Richard C. Pinkham
*Assistant Examiner*—Harry G. Strappello

[57] ABSTRACT

A golf game in which a game board is provided on which to determine a wind-condition for play and to mark and record player decisions relative to club selection, method of aiming, and the type shot that will be made. A plurality of fairways are provided on cards or boards preferably simulating an actual golf course i.e., there could be nine boards with a fairway on each side of the board simulating the eighteen fairways of an actual golf course. Each fairway board is marked to show the area, distance marker, selected terrain features, and areas that are possible landing sites for shot balls. The greens are color-coded for the purpose of defining putt difficulty. Before teeing off, a player spins the wind vane to determine the wind condition with which he must cope, then with reference to the fairway board, he chooses a club, the point of aim, and the type shot. These decisions are punched on to a calculator and totaled. The total is compared against a shot value card for the hole being played and the player marks his position on the fairway board unless his ball is lost, in water, or out-of-bounds--in which case he tees off again. In the course of play, the player's ball will come to rest on a color-coded green. At which time he throws a dice of the same color as that on which his ball rests on the green to determine the number of putts taken to hole out.

4 Claims, 9 Drawing Figures

SHOT VALUE CARD
HOLE #5 j1 j2

| | O | ↘ | ← | ↗ |
|---|---|---|---|---|
| 6 | YELLOW | GREEN | D | LOST |
| 7 | RED | RED | DB | RED |
| 8 | YELLOW | B | WATER | RED |
| 12 | D or E | RED | D | LOST |
| 14 | BLUE | YELLOW | YELLOW | YELLOW |
| 16 | B | WATER | YELLOW | GREEN |
| 18 | RED | BLUE | YELLOW | LOST |
| 21 | GREEN | YELLOW | RED | RED |
| 36 | YELLOW | RED | RED | OB |
| 42 | BLUE | WATER | BLUE | YELLOW |
| 48 | WATER | WATER | WATER | YELLOW |
| 54 | RED | RED | RED | E |
| 63 | BLUE | C | WATER | RED |
| 72 | WATER | WATER | WATER | YELLOW |

TEE SHOTS

IF YOUR SHOT VALUE IS NOT ABOVE---
YOUR SHOT IS IN SAND TRAP AT POSITION B j3 j4 j5 j6 j7

| | | | | |
|---|---|---|---|---|
| 48 | Red 120 | Blue 216 | Red 355 | GREEN |
| 56 | Blue 123 | Blue 224 | Green 360 | GREEN |
| 60 | Red 135 | Green 240 | Green 384 | WHITE |
| 66 | Green 140 | Red 252 | Blue 392 | GREEN |
| 70 | Blue 144 | Blue 256 | Green 420 | GREEN |
| 72 | Red 160 | Blue 270 | Green 480 | BLUE |
| 80 | Green 168 | Blue 280 | Green 525 | WHITE |
| 84 | Blue 175 | White 288 | Red 540 | GREEN |
| 90 | Blue 180 | Green 315 | Red 576 | WHITE |

OTHER SHOTS

IF YOUR SHOT VALUE IS NOT ONE OF THE ABOVE,
YOUR VALUE IS YELLOW j8

FIG. 5

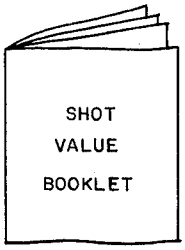

FIG. 4

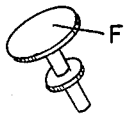

FIG. 2a

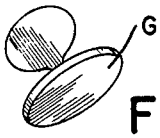

FIG. 2b

SCORE CARD

| HOLE | DISTANCE | PAR | SELF | PARTNER | OPPONENT | OPPONENT | W (+) L(−) D (o) |
|---|---|---|---|---|---|---|---|
| 1 | 148 | 3 | | | | | |
| 2 | 133 | 3 | | | | | |
| 3 | 167 | 3 | | | | | |
| 4 | 140 | 3 | | | | | |
| 5 | 120 | 3 | | | | | |
| 6 | 170 | 3 | | | | | |
| 7 | 100 | 3 | | | | | |
| 8 | 154 | 3 | | | | | |
| 9 | 180 | 3 | | | | | |
| Out | | 27 | | | | | |
| | | | | | | | |
| 10 | 148 | 3 | | | | | |
| 11 | 133 | 3 | | | | | |
| 12 | 167 | 3 | | | | | |
| 13 | 140 | 3 | | | | | |
| 14 | 120 | 3 | | | | | |
| 15 | 170 | 3 | | | | | |
| 16 | 100 | 3 | | | | | |
| 17 | 154 | 3 | | | | | |
| 18 | 180 | 3 | | | | | |
| IN | | 27 | | | | | |
| Out | | 27 | | | | | |
| Tot | | 54 | | | | | |

FIG. 6

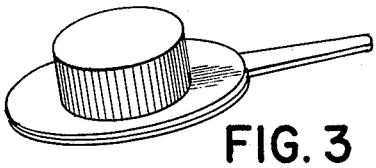

FIG. 3

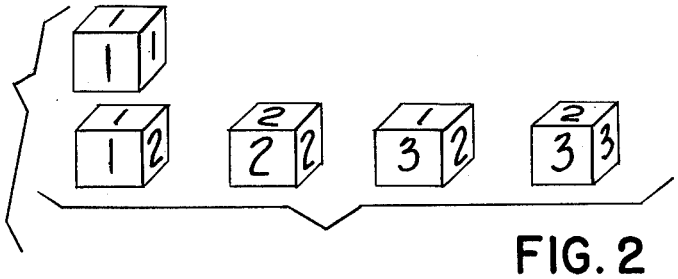

FIG. 2

GOLF BOARD GAME APPARATUS

The object of my invention is to provide a realistic game of golf to be played on a game board along with the necessary apparatus, by one or more players. In brief, a player is required to make decisions regarding selection of a club, point of aim, and the type shot he will make in conjunction with a wind condition. He then punches this decision onto a calculator whose mathematical response is compared with a shot-value card for that hole to locate his shot ball on a color-coded green, or in sand, water, out-of-bounds, lost, or other designated positions in the fairway. If the tee shot does not land on the green, the player continues to attempt to reach the green by reshooting, unless his ball is out-of-bounds, in water, or lost, in which case, he tees off again. When on the green, he rolls a dice that is color-coded and structured so as to give a high probability of a standard number of putts.

Realism is provided through the use of accompanying apparatus and through design features of the game. Apparatus in combination evoking realism are: boards which picture the holes to be played; a wind vane; immoveable decision boards; a calculator; and shot value cards used in conjunction with calculator output to determine the landing site of the player's shot.

I have designed this game with a view toward realism in that unwise decisions made by players will elicit a penalizing response from the calculator, in consort with shot-value cards, on shot attempts toward the green, which is the area of the course on which the hole is located. This was done by assigning a mathematical factor for each location, club, aiming point, and type shot during design of the calculator. Realism on the putting surface is provided in three ways: firstly, by color-coding the putting surface to coincide with the expected degree of difficulty of the putt. Secondly, five dice are also color-coded to correspond with the five colors used on the surface of the green, and the dice are marked so as to approximate the number of putting strokes that would normally be required in accordance with the degree of difficulty of the putt. Thirdly, the markings on the dice allow for an occasional lucky putt, i.e., in situations where the average number of required putts in three, there is approximately a 1 to 6 chance that only one putt would be required.

To generally describe the game, it will be necessary to refer to the various drawings which accompany and form a part of this specification.

In the drawings:

FIG. 2 is a perspective view of five chance dice bearing numbers on the various faces thereof for indicating the putts required;

Figure 1:
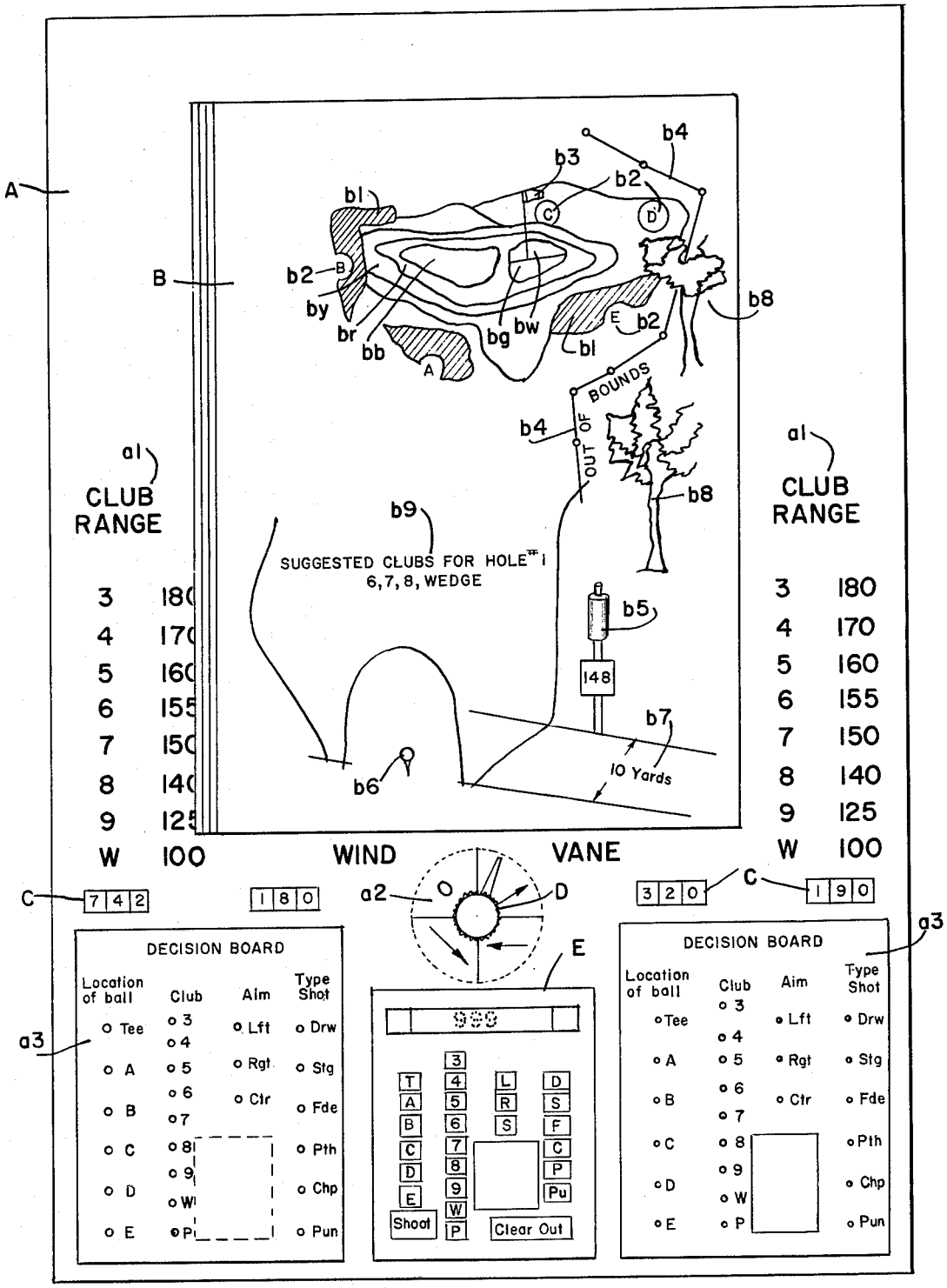
FIG. 1 is a perspective view of the game board, minus marking indicators for decisions and ball locations, and is laid out to some convenient scale.

FIG. 2*a* is a perspective view of one of a plurality of peg markers to be used by the players to indicate their four decisions in the "Decision Board" areas of the game board of FIG. 1;

FIG. 2*b* is a perspective view of one of the differently colored place markers, by which each player marks the location of his shot;

FIG. 3 shows the "wind vane" spinner that is attached to the game board;

FIG. 4 is a view of a booklet containing a "shot-value" card for each of the holes;

FIG. 5 is a perspective view of one of the "shot-value" cards which is used in conjunction with a calculator to indicate the locations of the players' balls under four wind conditions; The numbers shown at positions *j*2 and *j*5 through *j*7 are possible numbers which could appear as a sum on the calculator's visual display screen (VDU). For tee shots, this number is used in conjunction with the wind condition to tell the player the location of his ball, e.g., if a player on hole #5 gets a sum of 6 on the VDU while playing a wind condition of zero, his ball, as indicated on the shot value card for hole #5, has landed in the yellow portion on the green. For "other shots," the player simply conpares the number appearing on the VDU and looks to the right of that number on the shot value card to determine the placement of his ball on the green. Numbers displayed on the VDU which cannot be found on the shot value card require a ball placement as indicated by instructions shown at *j*3 and *j*8. Each shot value card is prepared as a consequence of mathematically determining where the ball will land. This is done by assigning a value for each position, club, aiming direction, and type shot and mathematically shooting each probable golf shot in a zero wind condition. The columns under the three other wind conditions are prepared as a result of visually determining where the shot will land if it is affected by the wind condition shown at *j*1.

Figure 7:
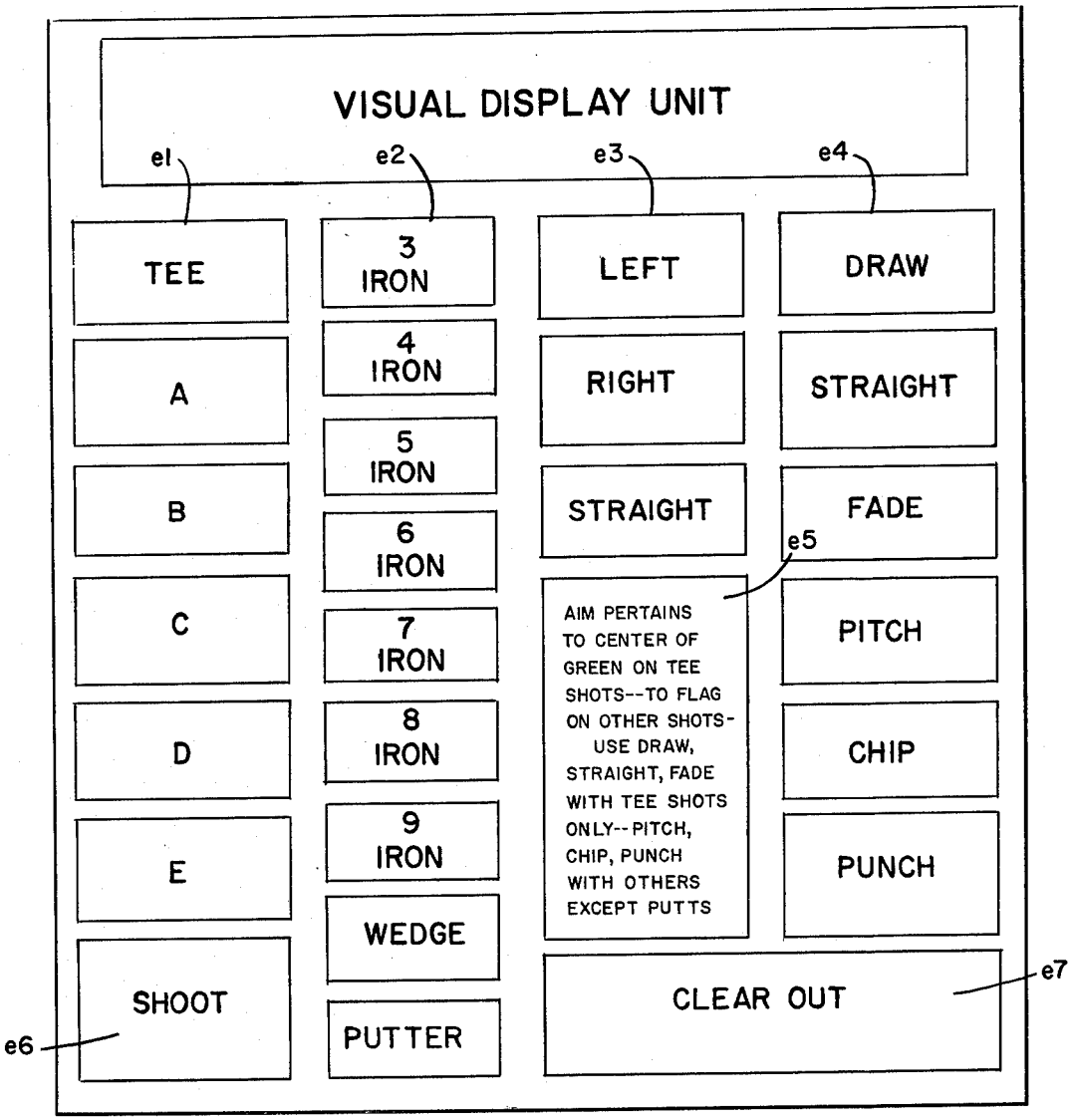

FIG. 6 is a detailed view of a score card to be used for scoring the game;

FIG. 7 is an enlarged view of the calculator. It represents the actual face of the calculator, and is laid out to some convenient scale.

Inasmuch as a golf game is played under varying conditions of weather, terrain, and shot difficulty in which thought processes come into play in regard to distance, selection of clubs, aiming points, type shots, obstacles, and penalties—this game was designed with these processes in view. In the printed instructions accompanying the game, I have covered rules, procedures, penalties, scoring, and some fourteen variations of the game.

With reference to the accompanying drawings, following is a detailed explanation to further describe that portion of the game needing amplification.

FIG. 1.

The game board illustrated in FIG. 1 is suitably colored. It consists of the game board proper A, on which is imprinted club ranges al, the wind direction portion of the "wind vane" *a*2, and "decision boards" *a*3, which are also impregnated at the sites of the crosses on the drawing as small holes to receive the peg markers (as shown at FIG. 2*a*). These peg markers, when inserted into the spaces on the decision boards as required, indicate the players' decisions which are to be factored by the calculator.

Item B indicates the nine "hole-layout" boards with the board for Hole no. 1 as the top-most board. The hole-layout boards are suitably colored. Numbered items on the hole-layout board for hole no. 1 indicate the following: *b*1-marks sand traps around the green; *b*2-marks positions from which second shots may be hit onto the green. These positions are lettered A, B, C, D, and E, however, other letters, numerals, or words may be used as well; *b*4-marks the out-of-bounds indicator; *b*5-marks the ball-washer which is used to indicate the distance to the green. Ground distance is measured from the ball-washer location to the center of the green;

*b*6-marks the ball on tee. It should be noted that the tee may be off-set from the distance indicator (ball-washer) as is usual on actual golf courses; *b*7-marks the off-set distance between the ball-washer and the tee position; *b*8-marks the trees on hole #1; *b*9-marks the note imprinted on the hole-layout board which suggests the clubs to be used during play of hole #1. The double-lettered items mark the colors on the green, which are colored to facilitate locating shots and determining which color dice will be rolled to provide a putting score. The colors WHITE, GREEN, BLUE, RED, and YELLOW are used on all greens for the game, however, other colors may be used as well. They indicate the least difficult to the most difficult putt, respectively. Area *bw*—is colored WHITE; area *bg*—is colored GREEN; area *bb*—is colored BLUE; area *br*—is colored RED; area *by*—is colored YELLOW. It should be noted here that the color-code technique, as well as the manner of marking off-the-green positions, *b*2, are readily adaptable for use in the fairways to indicate general and specific locations from whence the ball may be hit toward the green.

Item C marks the "value counters" which are built-in as part of the game board. The value counters serve as memory devices for calculated values of four players.

Item D marks the spinner-type "wind vane" wheel which is mounted on the game board atop of the imprinted wind-condition markers. The purpose of the wind vane is to point to the wind condition in which players must make tee-shots toward the green.

Item E marks the calculator on which player decisions are entered and factored in order to arrive at a value count for all shots except putts.

FIG. 2.

Item F of FIG. 2*a* is a drawing of one of the "peg markers" to be inserted in the holes impregnated on the decision boards. These markers, of one color, are provided so that each player may mark each of four decisions as required by the columns on the decision boards.

Item G marks "place markers," of different colors, by which each player marks the location of his shot as determined by reference to the shot value card for each hole (FIG. 5).

Item H is a perspective view of the five different colored die on each hole. A player rolls the die which corresponds with the color on the green on which the players marker sits. Dice values are as follows: WHITE—111112; GREEN—111122; BLUE—112222; RED—122223; YELLOW—122233.

FIG. 3.

This figure shows the spinner, a part of the wind vane, which has a pointer to indicate the effect of the wind on tee-shots.

FIG. 5.

The items at *j*1–*j*8 mark significant points on the shot value cards. Line *j*1—shows the four wind conditions associated with the calculated values for tee-shots on hole #5. Item *j*2—marks the column of shot values for tee shots; *j*3 and *j*8—mark the notations that pertain to the locations of shots in which no values are provided for tee shots and "other" shots respectively; *j*4 thru *j*7—mark shot value columns for other than tee shots.

FIG. 7.

The face of the calculator shown at FIG. 7 is designed to compliment the decision boards (shown in FIG. 1). Each key on the calculator is assigned a numerical value, which, when factored with a value from each of the other columns—cause a total shot value to appear on the visual display screen of the calculator. The top six keys under column el coincide with the location the ball is played from; the keys under column *e*2 coincide with the club selected. The putter key is for shots made toward the green with the putter; column *e*3 pertains to the aiming point, and column *e*4 pertains to the type shot; item *e*5—marks an instructional note which coincides with the same instructional note on the decision boards (as shown in FIG. 1). The key marked by *e*6—is the "total button." The key marked by *e*7—is designed to clear the visual display screen.

What is claimed is:

1. An indoor golf game apparatus comprising:

(a) a game board having indicia marked thereon relating to golf;

(b) a plurality of hole layout boards, each having a distinctive representation of a golfing hole layout marked thereon;

(c) a wind direction chance means located on said game board for randomly selecting one of several indicia representing various wind directions or no wind direction;

(d) at least one decision board means located on the game board for marking and recording four types of data selections comprising the location of the ball on the hole layout and the player's selections of the type of club, the direction of aim of the shot, and the type of shot he will make in view of the randomly selected wind condition derived by said wind direction chance means;

(e) a calculator means for receiving input of one each of the four types of data relating to the ball location and the player's selections of the type of club, the direction of aim of the shot, and the type of shot he will make in view of the randomly selected wind condition, said calculator means further comprising means for computing and visually displaying a numerical value uniquely based upon the combination of the four input data entered therein; and (f) a plurality of shot-value card means for determining the location of the ball after each shot on the hole layouts as determined by the numerical value computed by the calculator means and by the randomly selected wind condition or by the numerical value computed by the calculator means alone.

2. The apparatus according to claim 1 wherein the wind direction chance means comprises a rotatable wheel having a pointer thereon and a plurality of indicia on the game board selectable at random by said pointer, said indicia representing various wind directions or no wind direction.

3. The apparatus according to claim 1 wherein;

(a) the decision board means comprises four groups of indicia, each group containing a plurality of indicia and a peg hole adjacent to each indicium for receiving peg markers, the groups of indicia relating to various locations of the ball on the hole layout boards, various types of clubs, various directions of aim of the shot, and various types of shots, respectively; and (b) a plurality of peg markers receivable in said peg holes.

4. The apparatus according to claim 1 wherein;

(a) the calculator means comprises a visual display area and four groups of input data keys, each group containing a plurality of keys, the groups of keys relating to various locations of the ball, various types of clubs, various directions of aim of the shots, and various types of shots, respectively;

(b) each said input data key having associated therewith a numerical value whereby, once the player has keyed in the said four input data, a numerical result total of the individual values keyed-in is displayed in the visual display area;

(c) said calculator means further having an actuator key for causing the numerical total to be visually displayed in the display area; and (d) said calculator means further having thereon a deactuator key for deactuation and clearing of the visual display.

* * * * *